United States Patent [19]

Randen et al.

[11] Patent Number: 4,492,399

[45] Date of Patent: Jan. 8, 1985

[54] LIFTING HARNESS FOR LIFTING OF A LOAD CONSISTING OF TWO OR MORE ESSENTIALLY CYLINDRICAL OBJECTS IN AN UPRIGHT POSITION

[75] Inventors: Ilkka U. Randen, Rauma; Mikko Kiema; Lauri S. Porthen, both of Turku, all of Finland

[73] Assignee: Lassila & Tikanoja Oy, Helsinki, Finland

[21] Appl. No.: 380,943

[22] Filed: May 21, 1982

[30] Foreign Application Priority Data

| | | | |
|---|---|---|---|
| May 27, 1981 | [FI] | Finland | 811620 |
| Oct. 29, 1981 | [FI] | Finland | 813402 |
| Nov. 10, 1981 | [FI] | Finland | 813559 |
| Feb. 15, 1982 | [FI] | Finland | 820495 |

[51] Int. Cl.[3] ..... B66C 1/18

[52] U.S. Cl. ..... 294/74; 294/87 R

[58] Field of Search ..... 294/31.2, 74, 87 R, 294/87.2, 137, 146, 149, 150, 154–159, 162–165, 170; 206/150, 163, 428

[56] References Cited

U.S. PATENT DOCUMENTS

| | | | |
|---|---|---|---|
| 212,082 | 2/1879 | Young | 294/164 X |
| 799,793 | 9/1905 | Kinsella | 294/155 |
| 1,501,888 | 7/1924 | Meriwether | 294/74 |
| 1,551,886 | 9/1925 | Jensen | 294/74 |
| 1,839,636 | 1/1932 | Baker | 294/87 R X |
| 2,856,069 | 10/1958 | Felber | 294/87.2 X |
| 3,042,441 | 7/1962 | Jeffs et al. | 294/74 |

FOREIGN PATENT DOCUMENTS

| | | |
|---|---|---|
| 1087334 | 8/1960 | Fed. Rep. of Germany . |
| 1556776 | 3/1970 | Fed. Rep. of Germany . |

*Primary Examiner*—Johnny D. Cherry
*Attorney, Agent, or Firm*—Holman & Stern

[57] ABSTRACT

The invention relates to a lifting harness for lifting of a load comprising two or more essentially cylindrical objects (1), e.g. rolls of paper, which are in an upright position. The lifting harness is formed by two lifting slings (3), the ends of which are fashioned into eyes (4), and two endless lifting loops (5), each of which is joined to a different one of the lifting slings (3) and threaded through the eyes (4) of the other lifting sling (3). The lifting slings (3) are applied around the load (1) from opposite sides so that the lifting loops (5) extend above the load and this section of the lifting loops is attached to a lifting hook (2). On lifting, the lifting slings (3) are tightened around the load.

According to one form of embodiment of the invention one of the lifting slings together with its associated lifting loop is replaced by a combined lifting sling-lifting loop which passes through the eyes in the other lifting sling and thence extends upwards to the lifting hook. The other lifting sling does not have any associated lifting loop.

According to a further form of embodiment the harness consists of two combined lifting slings-lifting loops, each part consitituting a lifting sling with an eye in one end from which sling extends around one roll or paper and passes through the eye of the other sling, which is itself arranged in similar fashion, and thence extends upwards to the lifting hook, forming a hook loop together with the other part.

According to yet another form of embodiment the lifting loops joined to the lifting slings are replaced by one or two separate lifting loops (5) which pass through all four eyes (4) in the ends of the lifting slings (3) and thence extend upwards to the lifting hook (2) forming a hook loop. the lifting loops pass through the region between the two rolls of paper on their way from one eye to the next eye and thereby produce a tightening of the lifting slings.

12 Claims, 21 Drawing Figures

Fig. 9
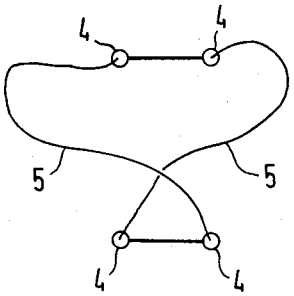
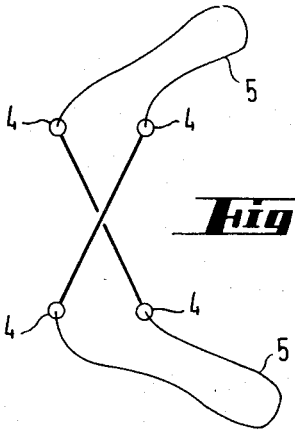
Fig. 10
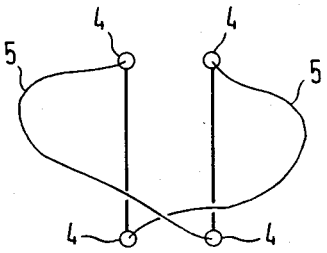
Fig. 11
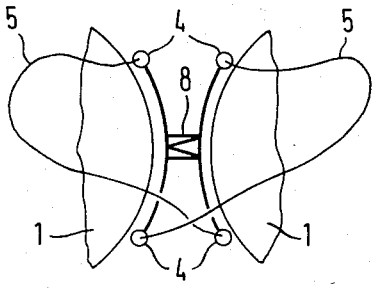
Fig. 11a
Fig. 12
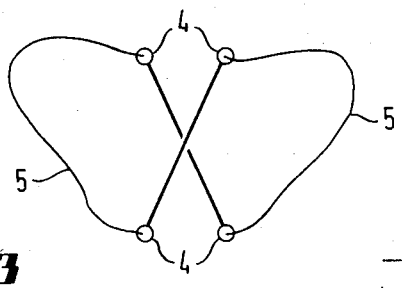
Fig. 13
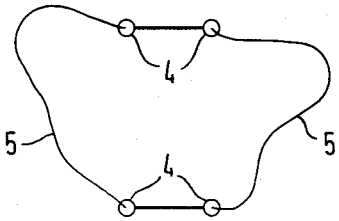
Fig. 13a
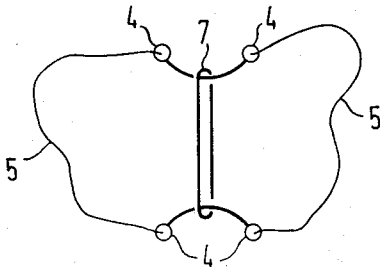

LIFTING HARNESS FOR LIFTING OF A LOAD CONSISTING OF TWO OR MORE ESSENTIALLY CYLINDRICAL OBJECTS IN AN UPRIGHT POSITION

BACKGROUND OF THE INVENTION

The present invention relates to a lifting harness for lifting a load consisting of two or more essentially cylindrical objects of essentially the same size and weight in an upright position.

The purpose of the invention is to provide a lifting harness by which the loading and unloading of a vessel is made easier and more efficient and in particular unloading at the opening, i.e. the point where unloading is begun, of easily damaged goods, such as rolls of paper, in an upright position. Facilitation of the opening of unloading is achieved by leaving the lifting harness according to the invention in place on the rolls of paper when they are loaded so that it is ready to hand when they are unloaded at the port of destination.

At present the opening position in the cargo hold is usually loaded with rolls of paper in a horizontal position and each roll is fitted with an individual lifting sling. This requires the use of trucks equipped with swiveling gripping claws, but there are relatively few such trucks in use. If, on the other hand, the opening position is loaded with rolls in an upright position it would be necessary to use vertical lifting claws, but use of these is slow and easily results in damage to the adjacent rolls.

SUMMARY OF THE INVENTION

The harness according to the invention succeeds in making loading and unloading, and particularly the opening of the load, simpler and more efficient.

The harness thus comprises two lifting slings, the ends of which are fashioned into eyes and which are intended to be applied around the load from opposite sides, and two endless lifting loops, each joined to a different one of the two lifting slings and threaded through the eyes of the other lifting sling and thence extending upwards above the load for attachment to a lifting hook.

The lifting slings, at least on that side which will face towards the load, are in a known fashion fitted with a friction-increasing covering or treated with a friction-increasing material.

When loading and unloading rolls of paper it is easy using the lifting harness according to the invention to achieve an opening position of the desired size in the cargo hold of the vessel by means of placing a suitable number of loads consisting, for example, of two rolls of paper together with their lifting harnesses in the opening position. When the opening is begun the lifting hook of the lifting means can be directly attached to the lifting slings of these ready-prepared loads. In this way opening is carried out quickly and the unloading can then be continued in some other prior-known way or in the same way.

In addition to its advantages in the opening of the cargo, the harness according to the invention is also advantageous in that it does not damage the rolls of paper or their wrapping paper. Moreover, it is easy to use and dependable, because it has no detachable parts and cannot be incorrectly fitted to the load. In addition the lifting harness is versatile, since it can be used both for rolls of paper of normal size and also for so-called half rolls.

In one form of embodiment of the invention the eyes are omitted from the ends of one of the lifting slings and the lifting loop is omitted from the other lifting sling. Thus the two parts of the lifting harness are single bands unlike the embodiment described earlier in which the lifting sling and lifting loop are sewn together over a great part of their lengths. The part of the lifting harness which is without eyes thus constitutes a combined lifting sling-lifting loop and is threaded through the eyes of the other part which is without a lifting loop and which corresponds to the second lifting sling in the principal embodiment.

The combined lifting sling-lifting loop is preferably, after having been threaded through the eyes in the other sling, sewn together to form an endless loop.

The lifting harness suitably includes two supporting straps, each fastened at both its ends to a different one of the lifting slings. The fastening is suitably carried out by sewing during manufacture. When the lifting harness is in use the supporting straps pass over the tops of the load objects, at approximately the mid-points of the surfaces, and downwards in the longitudinal direction of the objects to the fastening points. The length of the supporting straps is suitably such that when the lifting harness is loaded the points of intersection between the lifting sling with eyes and the combined lifting sling-lifting loop are at a height of between $\frac{1}{8}$ h and $\frac{1}{2}$ h measured from the upper edge of the load objects. The height of the objects, i.e. the length of the rolls, has here been denoted by h.

The purpose of the supporting straps is to prevent the lifting harness from sliding downwards when in the rest position. If the lifting harness lies too low on the load the loading points will be wrong. It can also be difficult to engage the lifting hook in the lifting loop if the harness is too low. The supporting straps can be made of comparatively narrow and thin webbing since they are not loadbearing.

At least the lifting sling which has eyes is covered with a friction-increasing material or treated with a friction-increasing material on the side which faces towards the load. The horizontal part of the lifting sling-lifting loop is also suitably treated or covered with a friction-increasing material.

The lifting sling which has eyes can, in addition to the eyes at each end, suitably have one or more supplementary eyes at one or both of its ends. In this way the same lifting sling with eyes is suitable for use with objects of different diameters. In this case the combined lifting sling-lifting loop cannot be sewn together to form an endless loop since it must be posssible to thread it through appropriately chosen eyes in the lifting sling. In this case the combined lifting sling-lifting loop suitably has eyes fashioned at its ends for attachment to the lifting hook and these eyes are suitably linked by some loop so that they are held together ready for insertion into the lifting hook during the unloading stage. The free ends can obviously be connected together for insertion into the hook also in some other fashion once they have been threaded through the eyes so as to form an endless loop which can be attached to the hook.

A significant advantage of this form of embodiment of the lifting harness is that it does not cause any indentation of the top edge of the object being lifted, which is a great benefit when lifting rolls of paper. This is a result of the fact that the lifting angle of the harness, i.e.

the angle formed by the lifting sling-lifting loop between the hook and the eyes the loop passes through, is in the common tangential plane between the rolls and thus does not intersect the outer surface of the rolls. The points of intersection between the lifting sling-lifting loop and the eyes are drawn somewhat inwards into the angular reqion between the rolls. Stretching of the slings and loops after use does not change this advantageous situation, and even after stretching the lifting loop is in the tangential plane and does not press against the rolls.

Other advantages of this form of embodiment is that the lifting harness is simple to produce and easy to use in both loading and unloading.

In a further simplified form of embodiment of the invention the slings and loops are combined so that the lifting harness has the form of a stylized figure eight, in which the loop connected the eight forms one lifting loop. The lifting slings of the harness each have an eye at each of their ends and encircle the objects so that the eyes in each sling are on opposite sides in the common tangential plane of the objects. From each eye one sling extends in the same direction, i.e. clockwise or counterclockwise, and passes through the opposingly disposed eye, from which both slings stretch upwards in the tangential plane in the form of a lifting loop to the lifting hook.

With a lifting harness according to this form of embodiment stable lifting is obtained because at the start of lifting the lifting loop tensions both the lifting slings evenly in both directions and each lifting sling moves in its eye to an extent determined by the tightening. Moreover, in this form of embodiment the lifting loop lies in the common tangential plane between the rolls and does not press against the top edges of the rolls.

The lifting slings are connected to each other during lifting by a binding which can either be re-openable or permanent. In the latter case the lifting harness has the form of a closed figure eight. It is easy to fit onto the load and it does not require any additional connection. A lifting harness of this type is manufactured from two lifting slings in order that they can be threaded through both the eyes, after which they are united to form a connected figure eight. The join between the lifting slings can be located at any point on the harness. The lifting slings are suitably treated or covered with a friction-increasing material at least on the side which is in contact with the load. Also this form of embodiment is suitably fitted with supporting straps which prevent the harness from sliding downwards along the rolls while at rest.

In still a further form of embodiment the lifting loops which are sewn to the lifting slings are replaced by one or two separate lifting loops, which instead of each being sewn to a different one of the lifting slings are sewn together to form a closed lifting loop after having been threaded through the four eyes in the ends of the lifting slings. The section of lifting loop or loops which runs bewteen the aforesaid four eyes crosses through in some direction the double-cone shaped region which is formed between the four eyes and the outer surfaces of the rolls.

The manufacture of this form of harness is extremely simple, since the lifting loop is or the lifting loops are simply threaded through the eyes of the lifting slings after which the ends are united so as to form an endless loop. The connection to form an endless loop can either be permanent or such that it can be opened after use.

It is also easy to fit the lifting harness onto the load since the construction is clear and it is easy to grasp the loops to tighten them and to insert the lifting hook.

The lifting slings can suitably be made of synthetic textile webbing. The lifting slings can suitably be covered or treated with a friction-increasing material, which is advantageously natural rubber. The lifting loops and also the connecting loops used in some forms of embodiment are suitably of the thinnest possible material in order to prevent the occurrence of indentations in the rolls.

BRIEF DECRIPTION OF THE DRAWINGS

The invention in the following with reference to the accompanying drawings, wherein:

FIG. 1 shows the lifting harness according to the invention arranged on a load consisting of two rolls of paper and attached to a lifting hook, FIG. 2 shows the load with the lifting harness seen from above, FIG. 3 shows another form of embodiment of the lifting harness arranged on a load consisting of two rolls of paper and attached to a lifting hook, FIG. 4 shows the load with a modification of the lifting harness according to FIG. 3, seen from above, FIG. 5 shows a further form of embodiment of the lifting harness arranged on two rolls of paper, FIG. 6 shows the rolls of paper with a modification of the harness of FIG. 5, seen from above, FIG. 7 shows yet another form of embodiment of the lifting harness arranged on two rolls of paper, FIG. 8 shows diagrammatically two rolls of paper with a variation of the lifting harness of FIG. 7, FIGS. 9–12 show diagrammatically, with only the eyes (4) and the lifting loops (5) being shown, various variations of the lifting harness of FIG. 8 comprising one lifting loop threaded in the form of a letter X, FIGS. 13 and 14 show in similar diagrammatic manner two variations comprising one lifting loop threaded in rectangular form, and FIGS. 15–17 show diagrammatically three variations which comprise two lifting loops.

DETAILED DESCRIPTION OF THE INVENTION

Figure 1:
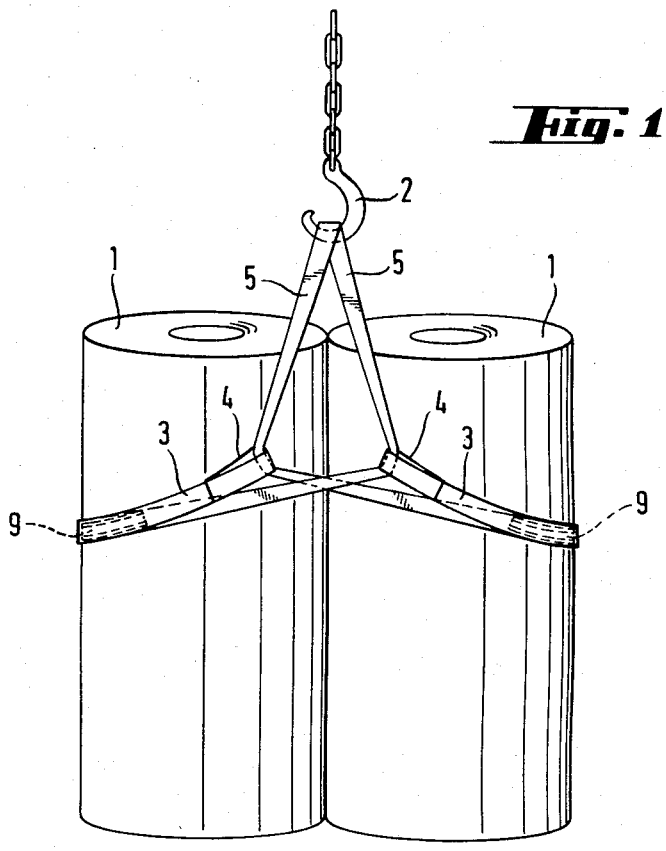

In FIG. 1 the two rolls of paper forming the load to be lifted are denoted by 1. The load is attached to the hook 2 of a lifting crane with the aid of the lifting harness according to the invention. The lifting harness consists of two lifting slings 3 applied around the rolls of paper 1 from opposite sides and two endless lifting loops 5. At both ends of the lifting slings 3 there are eyes 4 and for the rest of their lengths the lifting slings 3 are sewn to the corresponding lifting loops 5. The sewn part is also fitted with a strip of plastic cloth 9 sewn on at the same time, at least at the places which come into contact with the rolls of paper, in order to improve the friction between the lifting harness and the load. An example of a suitable plastic cloth material is cloth impregnated with a PVC plastic. Another suitable material is natural rubber, which in diverse weather conditions has proved to possess very good friction-increasing properties. The free ends of the lifting loops 5 are threaded through the eyes 4 of the opposing lifting slings. At a point above the load at which the hook 2 engages the lifting loops are sewn together with a thin band. This connection prevents the lifting loops 5 from falling down between the rolls when they are released from the hook. At the same time the bend prevents the lifting loops becoming twisted and thereby makes the lifting harness easier to use. Since the lifting loops 5 and the band connecting them are thin they do not damage the rolls of paper if they become crushed between two rolls.

The lifting slings 3 and the lifting loops 5 are suitably made of a webbing material of polyester yarn which is known per se. The eyes 4 of the lifting slings 3 can suitably be reinforced with leather, which reduces the friction and thereby makes it easier to fit the lifting slings onto the rolls.

Figure 3:
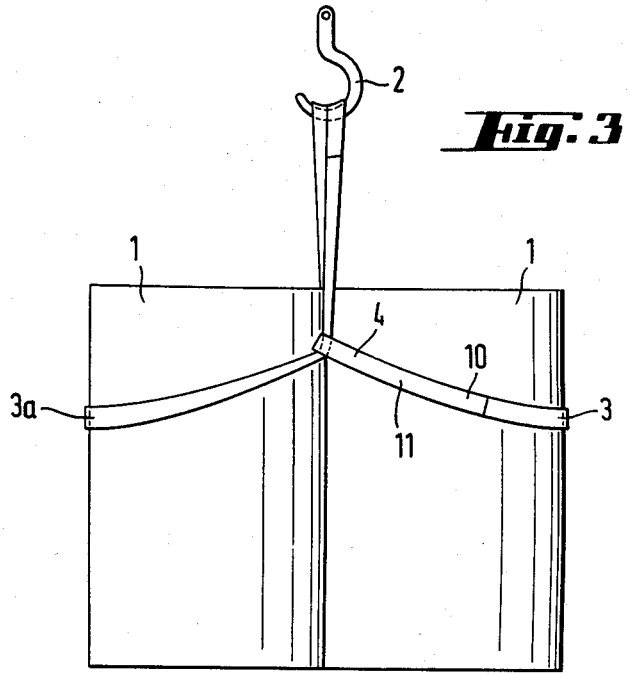
Figure 4:
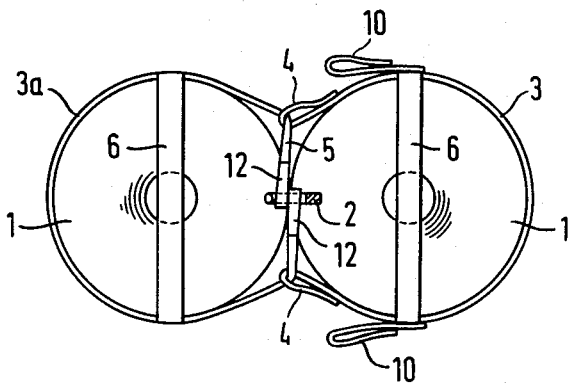

FIGS. 3 and 4 show two alternative forms of embodiment of the invention in which the eyes are omitted from the ends of one of the lifting slings and the lifting loop is omitted from the other lifting sling. The part of the lifting hardness which is without eyes then forms a combined lifting loop-lifting sling which is threaded through the eyes in the other part which has no lifting loop and corresponds to the second lifting sling in the principal embodiment. In the figures the lifting harness is fitted to a load consisting of two rolls of paper. The lifting sling with eyes is denoted by 3 and the lifting sling part of the combined lifting sling-lifting loop by 3*a* while the lifting loop part thereof is denoted by 5. The lifting harness shown in FIG. 4, seen from above, additionally exhibits a supporting strap 6 which runs across the top of the rolls. The lifting hook is again denoted by 2 and the eyes in the ends of the lifting sling 3 by 4. In FIG. 4 two supplementary eyes in the lifting sling 3 are denoted by 10. The number 11 denotes the end point of the friction-increasing material on the lifting slings 3 and 3*a*. The number 12 denotes the lifting eyes in the ends of the combined lifting sling-lifting loop which is here open at the ends.

When a load is lifted with the aid of the lifting harness the lifting slings 3 and 3*a* rise up the rolls somewhat thereby forming a small angle which becomes steeper nearer the point of intersection of the sling 3*a* and the eye 4. At the same time the aforesaid intersection points on either side are drawn nearer to each other in the region between the rolls.

In the form of embodiment of FIG. 4 a supplementary eye 10 is shown at either end of the sling 3, near to the main end eye 4. The lifting sling-lifting loop 3*a* is here shown running through the outer eyes, but with rolls of paper of somewhat smaller diameter one would choose the outermost eye 4 in one end and the supplementary eye 10 in the other end. The lifting eyes 12 of the lifting loop part 5 are connected to each other by a binding which is not shown.

Figure 5:
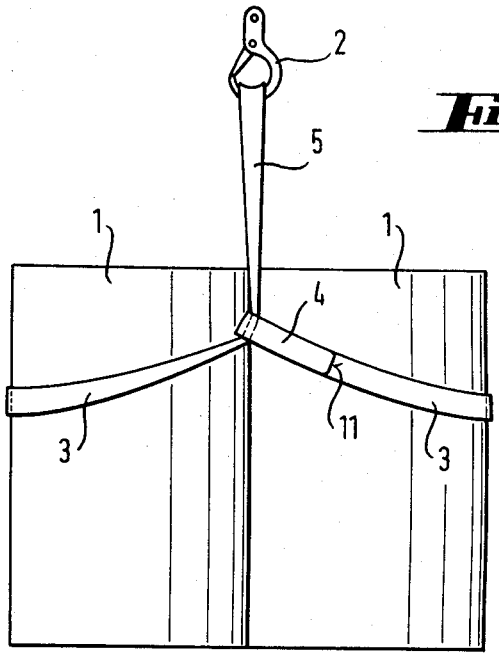
Figure 6:
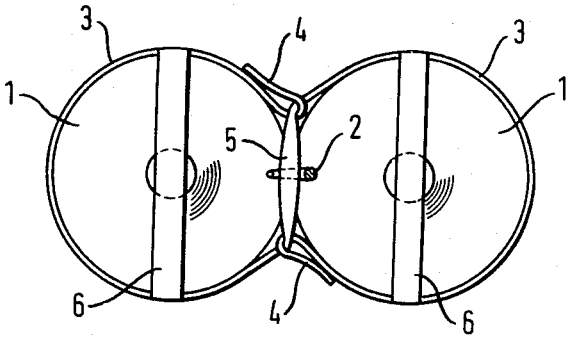

FIGS. 5 and 6 show the further simplified form of embodiment in which the slings and loops are combined so that the lifting harness has the form of a stylized figure eight, in which the loop connected the eight forms a lifting loop. In FIG. 5 a lifting harness is shown which consists of two lifting slings 3 which are combined in the tangential plane between the rolls of paper to form a connected figure eight. The point in the tangential plane where the slings are combined is conveniently taken as the location of the lifting loop 5 which is attached to the lifting hook 2. At the end of each lifting sling there is an eye 4. Starting from the eye 4 in the tangential plane, the lifting sling 3 runs counter-clockwise round its roll of paper and, starting from the other eye 4 on the opposite side of the load in the tangential plane, the other lifting sling 3 runs round its roll of paper also in a counter-clockwise direction and each of the lifting slings passes through the eye of the other in the tangential plane and is thereafter joined to a lifting loop. Each of the lifting slings is covered with a friction-increasing material which ends at point 11. FIG. 6 again shows the use of supporting straps 6 which run over the top of the paper rolls 1, approximately through their midpoints, and down to the points of attachment on the lifting slings.

When the lifting harness is loaded the lifting slings 3 rise up somewhat, thereby forming a small angle which becomes steeper nearer the eyes 4. The eyes remain in the tangential plane during lifting and at the same time are drawn a little nearer each other into the angular region between the rolls.

The lifting slings do not come into contact with the other surface of the rolls of paper and accordingly do not cause any indentations.

Figure 7:
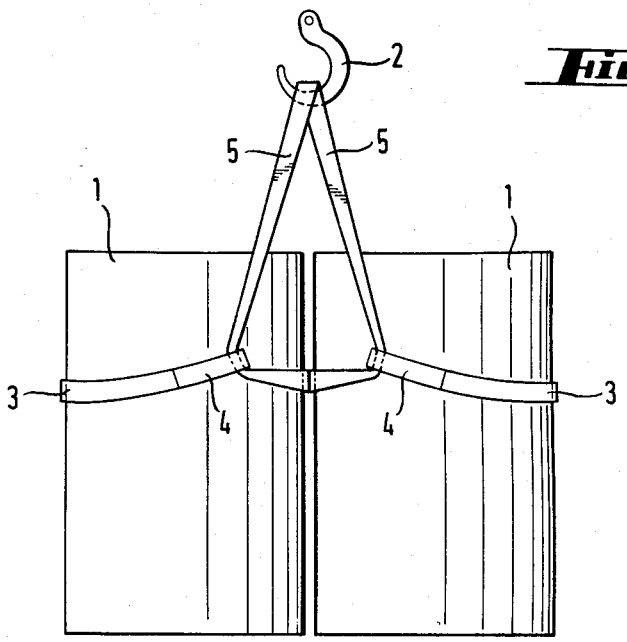

In FIGS. 7–17 a further form of embodiment is shown in which the lifting loops sewn to the lifting slings are replaced by one or two separate lifting loops, which instead of being sewn to the lifting slings are threaded through the four eyes in the ends of the slings and thereafter united to form one endless sling or two endless slings respectively. FIG. 7 shows a side view of two rolls of paper suspended from hook 2 by means of a lifting harness according to the invention. The form of embodiment shown in FIG. 7 corresponds to that of FIG. 11. This form of embodiment is described in greater detail in connection with FIG. 11.

Figure 8:
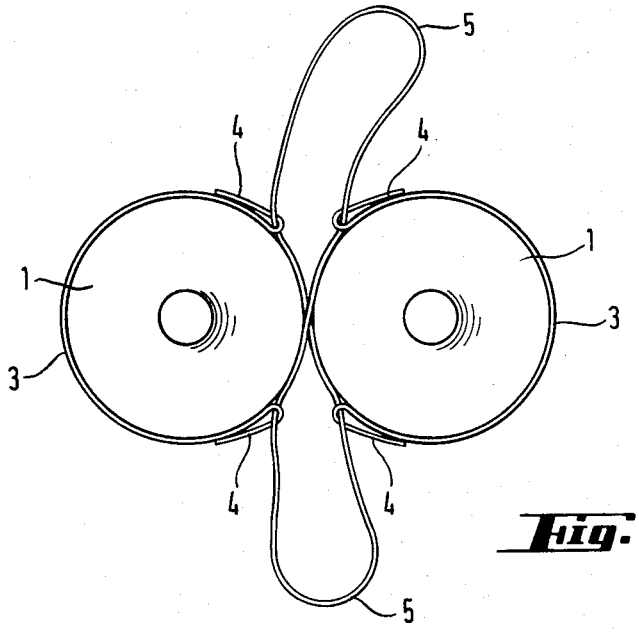

FIG. 8 shows diagrammatically two rolls of paper fitted with a lifting harness, seen from above. The embodiment of FIG. 8 correponds to that of FIG. 10 and will be described in greater detail in connection with that figure. The forms of embodiment according to FIGS. 7–14 show a lifting harness with one lifting loop, whereas FIGS. 15–17 show a lifting harness with two lifting loops.

Figure 14:
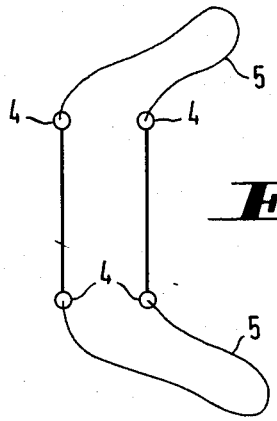

In FIGS. 9–12 the lifting loop is threaded in the form of a letter X whereas in FIGS. 13 and 14 the lifting loop is threaded in a rectangular configuration. In FIGS. 9 and 10 the sections of the loop which connect the parts of the cross with each other are parallel with the longitudinal direction of the load and in FIGS. 11 and 12 the corresponding sections are at right angles to the longitudinal direction of the load. In FIGS. 9 and 11 the sections of the loop which cross one another form the hook loops, which are attached to the hook 2, whereas in FIGS. 10 and 12 the straight parts of the loop form hook loops. In FIG. 11*a* the straight sections of the loop have been shown as bands which follow the curved outer surface of the rolls 1 and which are joined to each other by a short seam 8. The purpose of the seam is primarily to facilitate fitting of the lifting harness to the rolls.

In FIGS. 13 and 14 the lifting loop is threaded in the form of a rectangle, either clockwise or counterclockwise, passing in turn through each and every one of the eyes 4. In FIGS. 13 and 13*a* the sections of the loop which are at right angles in relation to the longitudinal direction of the load have been taken as the hook loops whereas in FIG. 14 the sections of the loop which are parallel to the longitudinal direction of the load have been taken as the hook loops. The form of embodiment according to FIG. 13*a* includes a connecting link 7 which is threaded around the parts of the loop which are parallel with the longitudinal direction of the load. The length of the connecting link is approximately equal to the radius of the rolls of paper. The purpose of the connecting link is to press the ends of the lifting loops against the surface of the rolls immediately during the initial stage of lifting, whereby the friction area and the frictional forces between the lifting slings and the outer surface of the rolls is increased and the slipping of the lifting slings upwards along the outer surface of the rolls during the initial stage of lifting is decreased. The forms of embodiment according to FIGS. 13 and 14 are particularly simple and easy to attach to the load.

Figure 15:
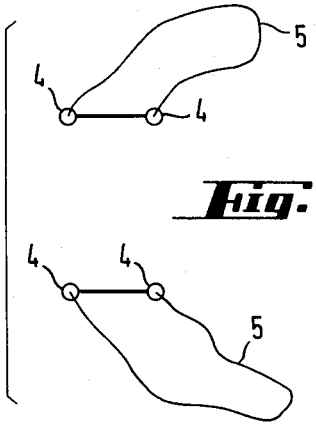
Figure 15A:
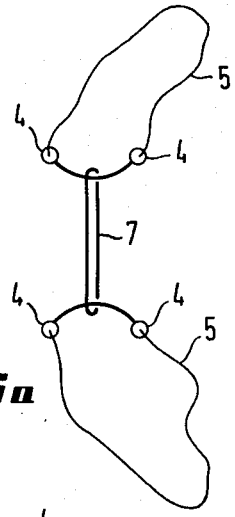
Figure 16:
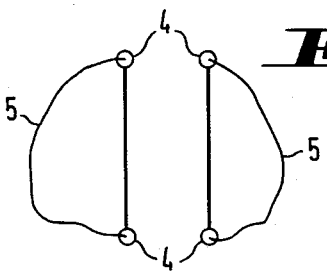
Figure 16A:
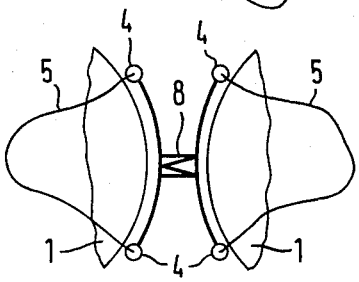
Figure 17:
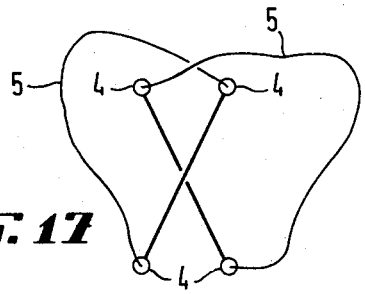

The forms of embodiment shown in FIGS. 15–17 comprise two lifting loops, which in FIGS. 15 and 16 are threaded in the form of a rectangular with the eyes 4 pair-wise connected by separate lifting loops and in FIG. 17 in the form of a letter X with diagonally opposed eyes being pair-wise united. In FIG. 15 each of the loops is threaded through two eyes oppositely disposed in the longitudinal direction of the load. One part of each lifting loop forms a hook loop which is attached to the hook 2. In FIG. 15*a* a connecting link 7 is threaded around one part of each loop, the purpose of this link being the same as in the embodiment of FIG. 13*a*. In FIG. 16 each of the lifting loops is threaded through two eyes which are opposingly disposed in the lateral direction of the load, i.e. through eyes in the same lifting sling. One part of each loop is attached as a lifting loop to the lifting hook. In FIG. 16*a* the parts of the slings which follow the outer surface of the rolls of paper are shown as arc-shaped bands, in accordance with reality, and are joined to each other by a short seam 8 as in FIG. 11*a*. The purpose of the seam is the same as that given in connection with FIG. 11*a*. In FIG. 17 each of the loops is threaded through diagonally opposed eyes. One part of each lifting loop forms a hook sling which is attached to the hook 2.

The forms of embodiment shown in FIGS. 15–17 work in principle in the same way as the correspondingly threaded lifting harnesses with only one lifting loop. The arrangement of the lifting harness on the rolls of paper is perhaps somewhat less convenient because the harness has more loops. In order to facilitate the placement of the harness on the load it is advantageous to connect the hook loops, for example with a leather sleeve.

The dependable operation of the lifting harness is based on the friction between the lifting slings and the rolls of paper. In the lifting harness according to the invention the lifting loops produce tensile forces in the lifting slings which press the slings over their whole length or almost their whole length against the outer surface of the rolls, whereby the friction is optimal.

This circumstance and the use of friction-increasing material on the lifting slings guarantees the necessary dependability in operation.

The lifting harness can be manufactured either for repeated use or for use once only. In the former case the factor of safety should be approximately 6–7, whereas in the latter case it can be approximately 3.5.

Figure 2:
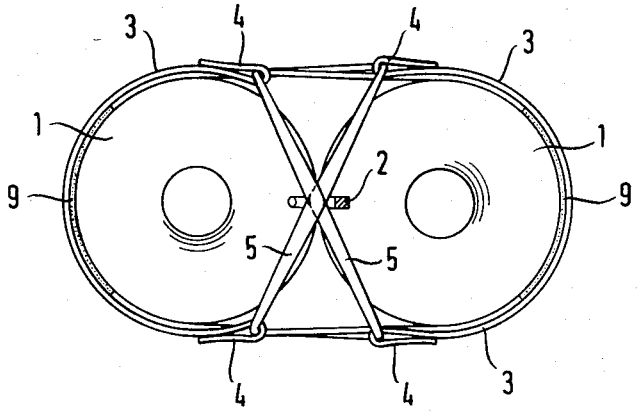

Concerning the dimensioning of the lifting harness, it can be suggested that with a form of embodiment according to FIGS. 1 and 2 for rolls of paper with a diameter of 8–100 cm and height 100 cm the length of each lifting sling can be approximately 210 cm, there being a section of approx. 35 cm at each end which is not sewn to the corresponding lifting loop, and the length of each lifting loop can be approx. 490 cm. If supporting straps are used their length is suitably about 175 cm for rolls of paper with the dimensions given. The dimensions for other forms of embodiment correspond broadly to those for the principal form of embodiment when these are converted to suit the different parts.

We claim:

1. A lifting harness for lifting of a load of two essentially uniform surfaced cylindrical objects in an upright position, characterized in that it comprises two lifting slings, which are intended to be applied around the load from opposite sides, the ends of one of the lifting slings are fashioned into eyes, said one lifting sling has additionally at least one eye adjacent at least one of its ends, and the other lifting sling is extended by a lifting loop which is threaded through two of the eyes of said one lifting sling and stretches upwards to a lifting means; said harness consisting essentially of non-metallic materials without hardware.

2. A lifting harness for lifting of a load of two essentially uniform surfaced cylindrical objects in an upright position comprising:

two lifting slings which are intended to be applied around the load from opposite sides, the ends of one of the lifting slings are fashioned into eyes;

the other lifting sling is extended by a lifting loop which is threaded through said eyes of said one lifting sling and stretches upwards to a lifting means; and two supporting straps, one of which straps is fixed at its ends to said one of the lifting slings and the other strap is fixed at its ends to the other lifting sling and the length of which straps is such that when the load is lifted each reaches from the point of attachment on the lifting sling over the top end of one of the respective cylindrical objects, approximately at its midpoint, and down to the other point of attachment on the lifting sling, said harness consisting essentially of non-metallic materials without hardware.

3. A lifting harness according to claim 1, characterized in that it further comprises two supporting straps, one of which straps is fixed at its ends to said one of the lifting slings and the other strap is fixed at its ends to the other lifting sling and the length of which straps is such that when the load is lifted each reaches from the point of attachment on the lifting sling over the top end of one of the respective cylindrical objects, approximately at its midpoint, and down to the other point of attachment on the lifting sling.

4. A lifting harness according to claim 3 or 2, characterized in that the lifting slings are, at least on the side which will face towards the load, fitted with a friction-increasing covering.

5. A lifting harness according to claim 1 characterized in that the lifting slings are, at least on that side which will face toward the load, fitted with a friction-increasing covering.

6. A lifting harness according to claim 1 characterized in that the lifting slings are, at least on that side which will face toward the load, treated with a friction-increasing material.

7. A lifting harness according to claim 3 or claim 2 characterized in that the lifting slings are, at least on that side which will face toward the load, treated with a friction-increasing material.

8. A lifting harness for lifting of a load of two essentially cylindrical objects of essentially the same size and weight in an upright position comprising:

two lifting slings, the ends of which are fashioned into eyes and which are intended to be applied around the load from opposite sides;

an endless lifting loop threaded in the form of a rectangle through all four eyes in such a way that said endless lifting loop stretches from one eye to the next in the region between the objects and leads to a lifting means;

the sections of the loop which are at right angles to the longitudinal direction of the load are attached to the lifting means; and a connecting link is threaded around two opposingly disposed sections of the lifting loop which are parallel to the longitudinal direction of the load, the length of said connecting link being approximately equal to the radius of the objects.

9. A lifting harness for lifting of a load of two essentially cylindrical objects of essentially the same size and weight in an upright position, comprising:

two lifting slings, the ends of which are fashioned into eyes and which are intended to be applied around the load from opposite sides;

two endless liftng loops each of which is threaded through two directly opposite eyes, parallel with the longitudinal direction of the load, in such a way that said lifting loops stretch from one eye to the next in the region between the objects and one part of each lifting loop leads to a lifting means; and a connecting link is threaded around two opposingly disposed sections of the lifting loop which are parallel to the longitudinal direction of the load, the length of said connecting link being approximately equal to the radius of the objects.

10. A lifting harness for lifting of a load of two essentially cylindrical objects of essentially the same size and weight in an upright position comprising:

two lifting slings, the ends of which are fashioned into eyes and which are intended to be applied around the load from opposite sides;

an endless lifting loop threaded in the form of a rectangle through all four eyes of the lifting slings in such a way that the lifting loop stretches from one eye to the next in the region between the objects, and the sections of the lifting loop which are parallel to the longitudinal direction of the load lead to and are attached to a lifting means; and the sections of the lifting loop which pass around adjacent surfaces of the objects are joined together by a short seam.

11. A lifting harness for lifting of a load of two essentially cylindrical objects of essentially the same size and weight in an upright position comprising:

two lifting slings, the ends of which are fashioned into eyes and which are intended to be applied around the load from opposite sides;

two endless lifting loops each of which is threaded through two directly opposite eyes of the lifting slings so as to form a double lifting-loop cross in such a way that the lifting loops stretch from one eye to the next in the region between the objects, and one part of each of the loops is led to a lifting means; and the sections of the lifting loop which pass around adjacent surfaces of the objects are joined together by a short seam.

12. A lifting harness for lifting of a load of two essentially uniform surface cylindrical rolls in an upright position, comprising:

two lifting slings which pass around the two rolls in the form of a figure eight, so that an eye fashioned in one end of each of the slings is on either side of the load in the tangential plane between the rolls, each lifting sling extending from the end eye in the same direction, clockwise or counter-clockwise, around the object and through the eye of the other lifting sling and thence extending in an upwards direction in the tangential plane in the form of a lifting loop to a lifting means;

and two supporting straps, of which one strap is joined at its ends to one of the lifting slings and the other strap at its ends to the other lifting sling, the length of which straps is such that when the load is lifted they reach from the point of attachment on the lifting sling over the top of each roll, approximately at its midpoint, and down to the other point of attachment on the lifting sling;

said harness consisting essentially of non-metallic materials without hardware.

* * * * *